US009401564B2

(12) United States Patent
Blakborn et al.

(10) Patent No.: US 9,401,564 B2
(45) Date of Patent: Jul. 26, 2016

(54) PLUG-TYPE CONNECTION WITH LOCKING ELEMENTS

(71) Applicant: ROSENBERGER HOCHFREQUENZTECHNIK GMBH & CO. KG, Fridolfing (DE)

(72) Inventors: Willem Blakborn, Inzell (DE); Thomas Lödding, Traunstein (DE)

(73) Assignee: Rosenberger Hochfrequenztechnik GmbH & Co., KG, Fridolfing (DE)

( * ) Notice: Subject to any disclaimer, the term of this patent is extended or adjusted under 35 U.S.C. 154(b) by 130 days.

(21) Appl. No.: 14/358,322

(22) PCT Filed: Oct. 22, 2012

(86) PCT No.: PCT/EP2012/004418
§ 371 (c)(1),
(2) Date: May 15, 2014

(87) PCT Pub. No.: WO2013/072002
PCT Pub. Date: May 23, 2013

(65) Prior Publication Data

US 2014/0322948 A1 Oct. 30, 2014

(30) Foreign Application Priority Data

Nov. 15, 2011 (DE) ..... 20 2011 107 900 U

(51) Int. Cl.
*H01R 13/627* (2006.01)
*H01R 13/53* (2006.01)
(Continued)

(52) U.S. Cl.
CPC ..... *H01R 13/627* (2013.01); *H01R 13/53* (2013.01); *H01R 13/62905* (2013.01); *H01R 13/44* (2013.01)

(58) Field of Classification Search
CPC ..... H01R 13/6275; H01R 13/6272; H01R 13/627; H01R 13/6215
USPC ..... 439/350, 358, 359, 364, 352
See application file for complete search history.

(56) References Cited

U.S. PATENT DOCUMENTS 4,408,822 A 10/1983 Nikitas
5,676,560 A 10/1997 Endo
6,533,600 B1 * 3/2003 Kashiyama ..... H01R 13/641 439/352

(Continued)

FOREIGN PATENT DOCUMENTS

EP 0696828 A1 2/1996

*Primary Examiner* — Hae Moon Hyeon
(74) *Attorney, Agent, or Firm* — DeLio, Peterson & Curcio, LLC; Robert Curcio

(57) ABSTRACT

A plug-type connection with a first plug-type connector and a second plug-type connector, wherein the plug-type connectors each have at least one electrical contact element, which electrical contact elements can be brought into contact with one another by plugging together the first plug-type connector and the second plug-type connector, and the first plug-type connector has a first locking element, with which a second locking element of the second plug-type connector can be latched with tensile and/or shear strength in a locking position of the plug-type connection, wherein the first locking element and/or the second locking element can be shifted by a shifting apparatus in the plug-in direction relative to the contact element of the associated plug-type connector into a contact position of the plug-type connection in order to make contact between the contact elements of the plug-type connectors.

20 Claims, 6 Drawing Sheets

(51) Int. Cl.
*H01R 13/629* (2006.01)
*H01R 13/44* (2006.01)

(56) References Cited

U.S. PATENT DOCUMENTS 7,458,835 B2 * 12/2008 Kobayashi ..... H01R 13/641 439/188
7,811,115 B1 * 10/2010 Tyler ..... H01R 13/53 439/352
8,821,180 B2 * 9/2014 Blakborn ..... H01R 13/6277 439/357
2001/0046814 A1 * 11/2001 Tsuji ..... H01R 13/641 439/625
2009/0298320 A1 * 12/2009 Schmitt ..... H01R 13/6275 439/352
2013/0122732 A1 * 5/2013 Blakborn ..... H01R 13/6277 439/357
2014/0206220 A1 * 7/2014 George ..... H01R 13/641 439/350

* cited by examiner

PLUG-TYPE CONNECTION WITH LOCKING ELEMENTS

BACKGROUND OF THE INVENTION

1. Field of the Invention

The invention relates to a plug-type connection with a first plug-type connector and a second plug-type connector, wherein the first and second plug-type connector each have at least one electrical contact element, which electrical contact elements can be brought into contact with one another by plugging together the first plug-type connector and the second plug-type connector. In particular, the invention relates to a plug-type connection for connecting high voltage cables such as are used, in particular, in electrically driven motor vehicles.

2. Description of Related Art

Such a plug-type connection of the generic type is for example known from DE 10 2009 053 779 B3.

A problem which arises with such plug-type connections designed for the connection of high voltage cables lies in the design of the contact elements which are to be connected, one of which is regularly designed as a socket and the other as a male connector which engages in the socket. In order to allow high currents to be transmitted, these contact elements are designed with large dimensions. The two contact elements also need to be brought into contact under a relatively high pressure in order to ensure a secure transmission of the electrical energy. Where the contact elements are designed as a socket and male connector, this leads to relatively high plugging and unplugging forces.

It is known for these plugging and unplugging forces to be applied via a screwed connection. Other embodiments provide for the application of the plugging and unplugging forces via a lever which, when pivoted, moves the two plug-type connectors together via a connecting member. Although a plug-type connection allows a convenient and rapid contacting of the two plug-type connectors, due to the pivoting movement of the lever it takes up a lot of space which, in particular where used in the engine compartment of a motor vehicle, is frequently not available.

Further requirements are imposed on plug-type connections of the generic type, in particular on ones which are used in motor vehicles. These relate in particular to the safety of the assembly personnel plugging together the plug-type connectors as well to the protection of the electronic components built into the motor vehicle. For example, in addition to the contact elements provided for the transmission of the high voltages, further contact elements are to be integrated in the plug-type connector which form part of a (12V) low voltage safety circuit. In this case the high voltage is only applied to the high voltage cables which are to be connected via the plug-type connector when the further contact elements, also integrated in the low voltage safety circuit, are also contacted. Accordingly, the plug-type connectors are designed such that, during the plugging movement, the contact elements for the high voltage cables are contacted first and only then the contact elements for the low voltage safety circuit. During disconnection, the contact elements of the low voltage safety circuit are first disconnected, which, where this has not already occurred, interrupts the supply of high voltage to the high voltage cables. Only then are the contact elements of the high voltage cables disconnected. This ensures that the high voltage cables are only supplied with high voltage when the contact elements of the plug-type connections designed for the transmission of high voltages make secure contact. This prevents a spark-over when plugging together or disconnecting the plug-type connection when high voltage is present, which could lead to injury to the assembly personnel and to burning of the contact elements.

SUMMARY OF THE INVENTION

Starting out from this prior art, the invention was based on the problem of further improving a plug-type connection of the generic type, in particular for high voltage applications in motor vehicles. In particular, the plug-type connection should be distinguished through simple and secure contacting as well as a low space requirement when plugging together.

This problem is solved through a plug-type connection in accordance with the claims. Advantageous embodiments of the plug-type connection according to the invention are the subject matter of the claims and are explained in the following description of the invention.

The above and other objects, which will be apparent to those skilled in the art, are achieved in the present invention which is directed to a plug-type connection comprising a first plug-type connector and a second plug-type connector, wherein the first and the second plug-type connector each possess at least one first electrical contact element, which electrical contact elements can be brought into contact with one another by plugging together the first plug-type connector and the second plug-type connector, such that the first plug-type connector includes a first locking element with which a second locking element of the second plug-type connector can be clipped together in a manner resistant to tensile and compressive forces in a locking position of the plug-type connection, wherein the first and/or the second locking element can be moved, through a shifting apparatus, in the plugging direction relative to the contact element of the associated plug-type connector, into a first contact position of the plug-type connection in order to make contact between the contact elements of the first plug-type connector and the second plug-type connector.

The first locking element may comprise a projection or a recess and the second locking element comprises an elastically deflectable locking tab which snaps around the projection or engages in the recess.

Starting out from the locking position, the first and/or the second locking element may be shiftable into a release position of the plug-type connection in which the clip connection of the first and second locking elements is released.

The first and the second locking element may also include sloping surfaces designed such that the shift into the release position leads to a deflection of the locking tab. The first and/or the second locking element may be loaded in the direction of the locking position through a spring element which is pre-biased in the release position.

The first and the second plug-type connector may each include at least one second electrical contact element which makes contact in the locking position. Additionally, the first and the second plug-type connector may each include at least one further electrical contact element which makes contact in a second contact position, wherein the second contact position is achieved, starting out from the locking position, by shifting the first and/or the second locking element beyond the first contact position.

The plug-type connection may include a securing device which prevents a release of the clip connection of the first and second locking elements in the first and/or second contact position.

The plug-type connection may further include a sealing element which, in the first and/or second contact position, is deformed into a gap formed between the first and second plug-type connector and which is not deformed in the locking position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
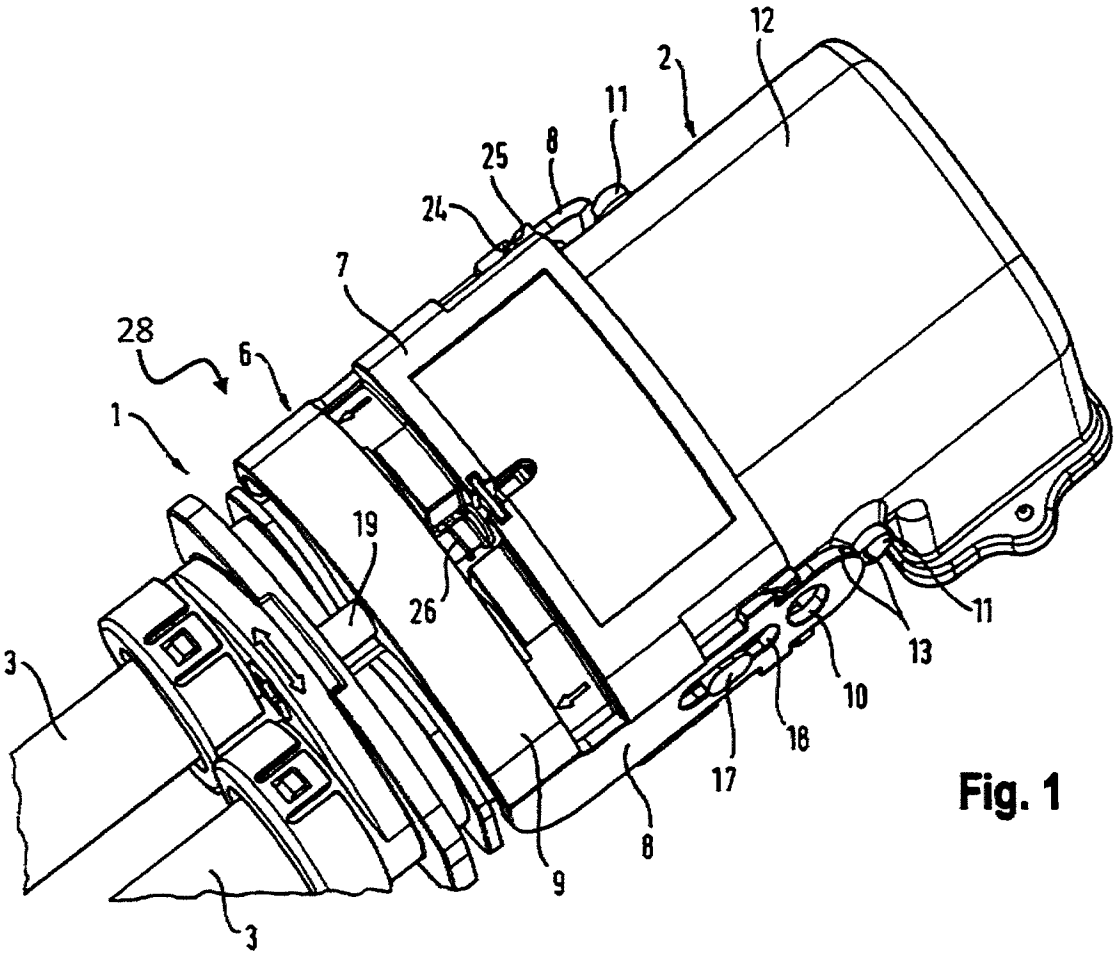
FIG. 1 shows a plug-type connection according to the invention in an unlocked position of the two plug-type connectors.

In describing the preferred embodiment of the present invention, reference will be made herein to FIGS. 1-6 of the drawings in which like numerals refer to like features of the invention.

According to the invention, a plug-type connection of the generic type with a first plug-type connector and a second plug-type connector, which each possess at least one (first) electrical contact element, which electrical contact elements can be brought into contact with one another by plugging together the first plug-type connector and the second plug-type connector, is characterized in that the first plug-type connector possesses a first locking element which can be clipped together with a second locking element of the second plug-type connector in a locking position of the plug-type connection, secure against the application of pressure and/or tensile forces, wherein the first and/or the second locking element can, through a shifting apparatus, be displaced in the plugging direction relative to the contact element of the associated plug-type connector into a (first) contact position of the plug-type connection in order to bring the contact elements of the first and of the second plug-type connector into contact.

The invented design of a plug-type connection of the generic type allows a reliable and convenient plug connection (plugging together/disconnection) to be realized. It makes it possible, in a first step, to plug together the two plug-type connectors manually and lock these by means of the clip connection in accordance with the invention. This means that these can already be connected together in such a way that an unintentional (complete) disconnection can no longer take place. This makes it possible to let go of the plug-type connection or only hold it in one hand. Then—in a second step—using the shifting apparatus acting on the first and/or the second locking element, the two plug-type connectors or at least their contact elements can be moved relative to one another in order to bring these into contact with one another. The possibility of putting down the plug-type connection or at least being able to hold it with only one hand without the two plug-type connectors becoming completely disconnected from one another means that the shifting apparatus can be operated with at least one free hand.

The shifting apparatus can for example be designed in the form of one or several threaded spindles via which, simply and comfortably, sufficiently high forces can be applied to also allow large contact elements, such as are usual for plug-type connections designed for high voltage applications, to be securely brought into contact with one another.

Preferably, the locking elements are clipped together in a manner resistant to tensile and compressive forces, so that the shifting apparatus can be used not only to effect the plugging movement for contacting the two contact elements but also the disconnecting movement which is performed in the opposite direction.

"Resistant to tensile forces" means a design which permits the transmission of a tensile load via the clip connection. Accordingly, "resistant to compressive forces" means a design which permits the transmission of compressive forces via the clip connection. The direction of the compressive or tensile load thereby applies to the plugging and unplugging direction of the plug-type connection.

In a preferred embodiment of the plug-type connection according to the invention, the first locking element can be in the form of a projection or a recess and the second locking element in the form an elastically deflectable locking tab which snaps around the projection or engages in the recess. This represents a constructively simple and economic possibility for providing a clip connection which can be used repeatedly.

Also preferably, a release device can be provided which releases the clip connection of the first and second locking elements in a release position of the plug-type connection in which the contact elements are not in contact. Preferably, starting out from the locking position, the plug-type connection can thereby be brought into the release position by applying tensile force to the two plug-type connectors. Accordingly, in order to (completely) disconnect the two plug-type connectors it can be the case these must first be brought (back) into the locking position by means of the shifting apparatus and the complete disconnection is then effected through the application of tensile force, passing through the release position of the plug-type connection. This embodiment allows a rapid and convenient disconnection of the plug-type connection.

Such a release device can be formed, in a simple manner, in that the first and the second locking element possess sloping surfaces which are so designed that the movement of the two plug-type connectors into the release position leads (as a result of the sloping surfaces sliding towards one another) to a deflection of one of the locking elements, designed, for example, as an elastic locking tab.

In order to prepare the plug-type connection for subsequent connection following the complete disconnection of the two plug-type connectors, it can be the case that the first and/or the second locking element automatically assumes the locking position again following complete disconnection of the plug-type connection. This can be achieved by means of a spring element pre-biased in the release position.

The first and second plug-type connectors of the invented plug-type connection can each possess at least one second electrical contact element which already make contact in the locking position. These contact elements can preferably be earth contact elements which can also be designed, in particular, in the form of a shielding enclosing the first contact elements.

The first and second plug-type connectors can also each possess at least one further (if necessary third) electrical contact element which make contact in a second contact position, wherein the second contact position is achieved, starting out from the locking position, by shifting the first and/or the second locking element beyond the first contact position. These contact elements can preferably be ones which are integrated into a low voltage safety circuit. The application of a high voltage to the first contact elements can be controlled via these. In particular, it can be the case that a voltage can only be applied to the first contact elements of the plug-type connection according to the invention when the contact elements of the low voltage safety circuit are in contact. Since, starting out from the locking position, the second contact position lies behind the first contact position (in relation to the plugging-together movement of the two plug-type connectors), it is ensured that the first contact elements always make contact when the same also applies to the further contact elements.

In a further preferred embodiment of the plug-type connection according to the invention, a securing device can be provided which prevents a release of the clip connection of the first and second locking elements in the first and/or second contact position. This allows an unintentional or undesirable disconnection of the plug-type connection in the contact position/s to be prevented.

In a further preferred embodiment of the plug-type connection according to the invention, a sealing element can be provided which, in the first and/or the second contact position, is deformed into a gap formed between the first and the second plug-type connector and which is not deformed in the locking position. Such a sealing element can significantly increase the forces necessary in order to connect the two plug-type connectors. Through this preferred embodiment it can be ensured that these forces are only increased by the sealing element when the relative movement between the plug-type connectors is generated via the shifting apparatus. Accordingly, a manual plugging together of the two plug-type connector as far as the locking position is not impeded through the sealing element.

The plug-type connection represented in FIGS. 1 to 6 comprises a first plug-type connector 1 and a second plug-type connector 2. The plug-type connectors 1, 2 serve to connect cables intended for the transmission of high voltages. While the first plug-type connector 1 is designed for connection to a total of two high voltage cables 3, the second plug-type connector is designed to be flanged onto a housing of another component (not shown), for example of an electric motor for driving a motor vehicle.

The first plug-type connector 1 is provided with two plug-formed (high voltage) contact elements 4 arranged within a housing 7 which are each connected with one of the high voltage cables 3. For electrical contacting (in a contact position) of the plug-type connection, the two plug-formed high voltage contact elements 4 of the first plug-type connector 1 are plugged into socket-formed high voltage contact elements 5 of the second plug-type connector 2. For this purpose, the two plug-type connectors 1, 2 are moved relative to one another, i.e. pushed together, in the plugging direction of the plug-type connection (this corresponds to the longitudinal direction of the contact elements 4, 5 of the first and of the second plug-type connector 1, 2).

FIG. 1 shows the plug-type connection in an unlocked position of the two plug-type connectors 1, 2, i.e. the two plug-type connectors 1, 2 have already been placed against one another, but have not yet been connected.

Figure 2:
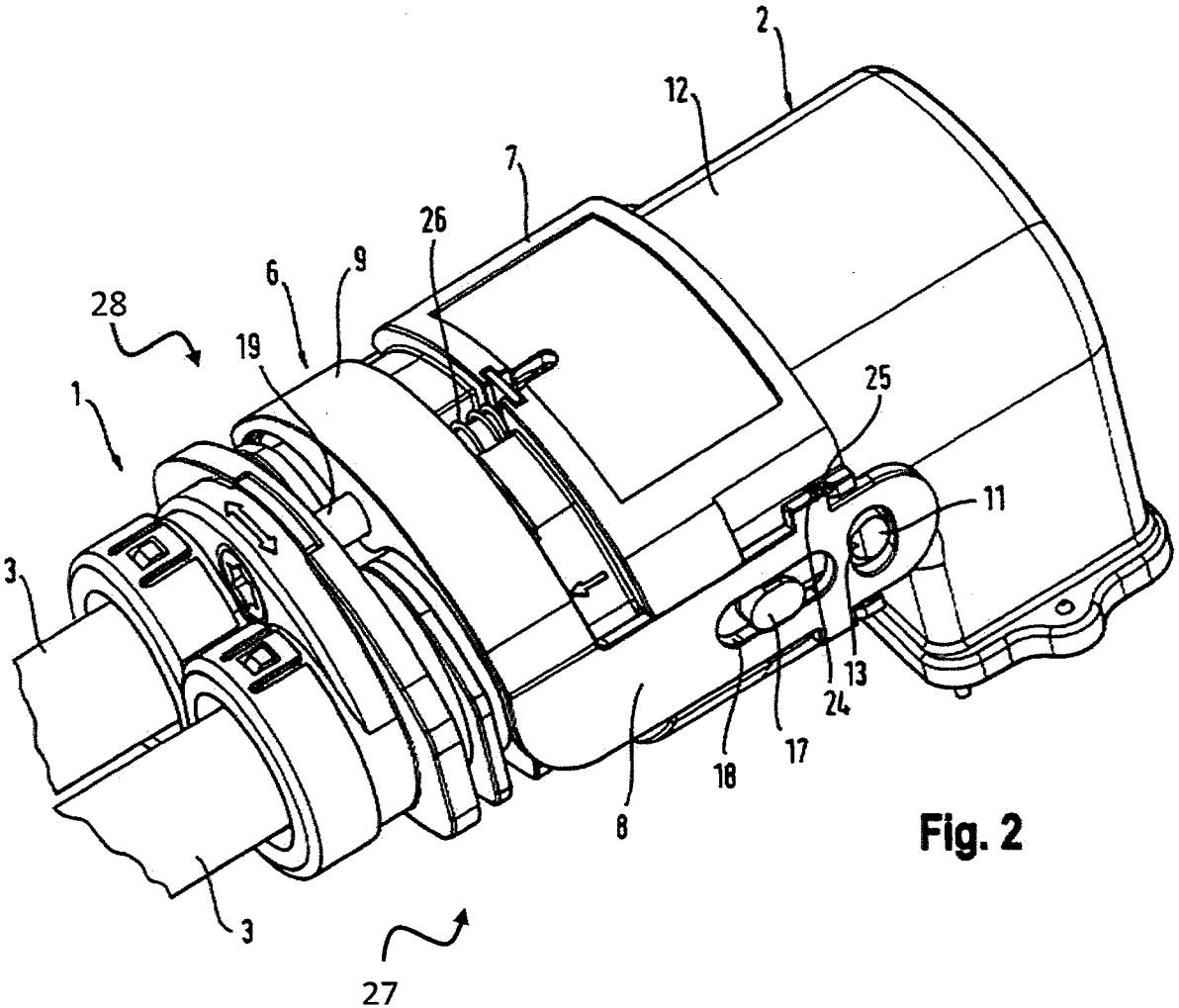
FIG. 2 shows the plug-type connection as shown in FIG. 1 in a locking position.
Figure 3:
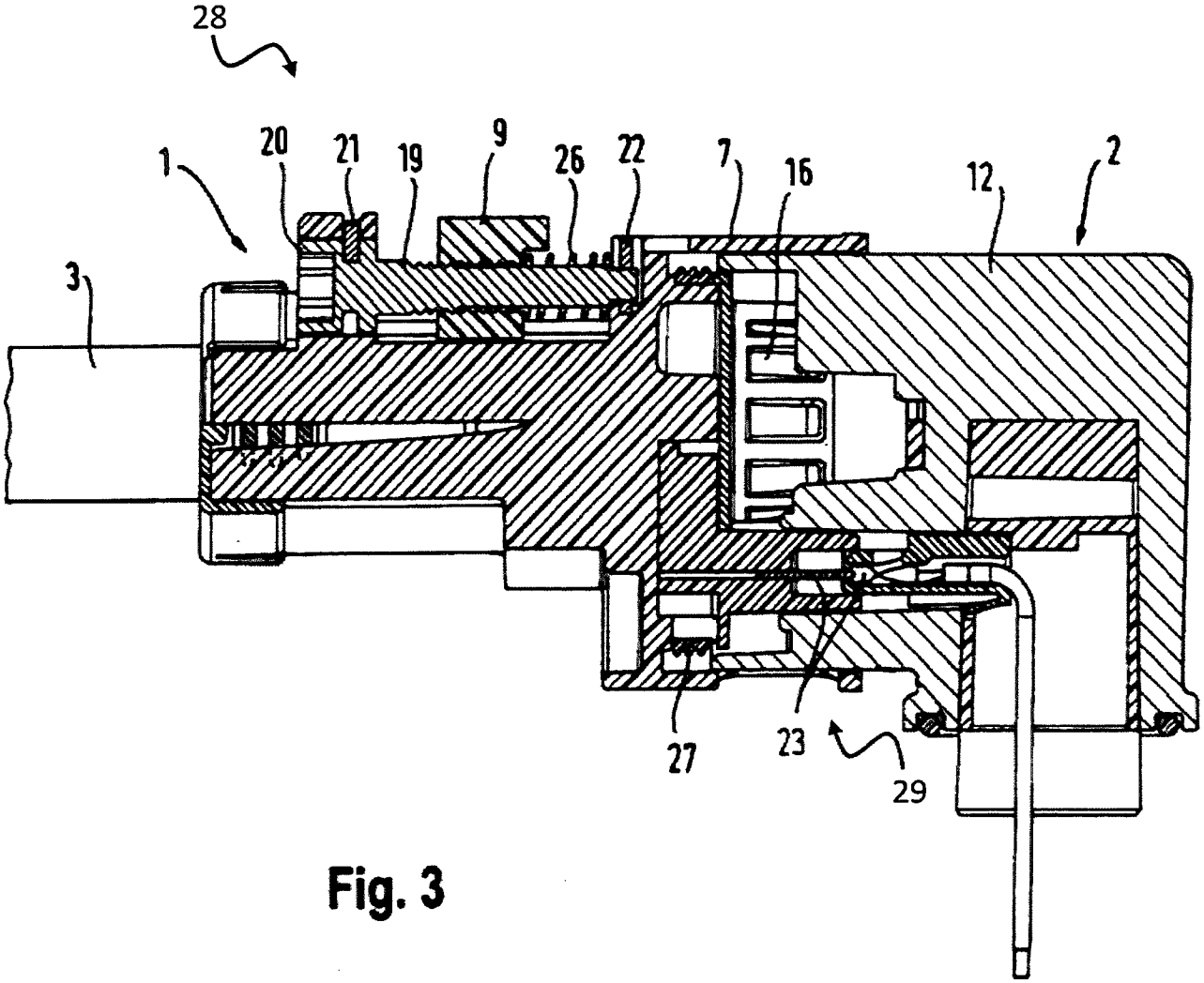
FIG. 3 shows a layered longitudinal section through the plug-type connection as shown in FIG. 2 in a vertical direction.
Figure 4:
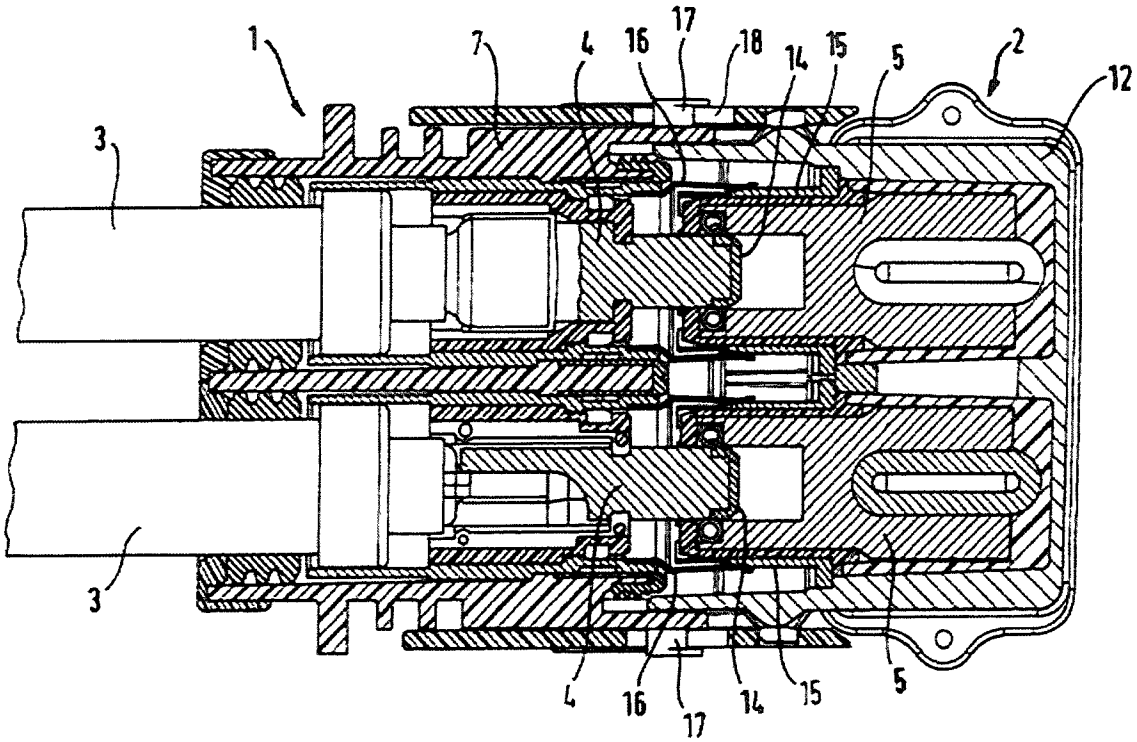
FIG. 4 shows a longitudinal section through the plug-type connection as shown in FIG. 2 in a horizontal direction.

An initial connection of the two plug-type connectors 1, 2 takes place in a locking position of the plug-type connection shown in FIG. 2 by means of engaging locking elements of the two plug-type connectors. For this purpose the first plug-type connector 1 possesses a locking bracket 6 which is mounted displaceably (within limits) in the plugging direction of the plug-type connection on the housing 7 of the first plug-type connector 1. The locking bracket 6 comprises two laterally arranged locking tabs 8, one end of each being connected via a bridge 9 of the locking bracket 6. The locking tabs 8 are manufactured of an elastically deformable material in order to allow a defined lateral deflection of the free ends of the locking tabs 8. In the region of their free ends, the locking tabs 8 are each provided with a locking aperture 10. These are each designed to engage around a locking projection 11 formed by a housing 12 of the second plug-type connector 2 in order to create a form-locking connection between the first plug-type connector 1 and the second plug-type connector 2. This form-locking connection allows the transmission of both tensile forces and also compressive forces (in relation to the plugging direction).

In order to achieve the locking position of the plug-type connection as shown in FIG. 2, the two plug-type connectors 1, 2 are brought together manually so far that the locking projections 11 of the second plug-type connector 2 engage in the locking apertures 10 the locking tabs 8 of the first plug-type connector 1. This requires a deflection of the locking tabs 8, which occurs automatically by means of sloping surfaces 13 of the locking projections 11 and the locking tabs 8 which slide over one another and as a result of the relative movement the two plug-type connectors 1, 2. After the locking projections 11 and the locking tabs 8 have clipped together, a further plugging together of the two plug-type connectors 1, 2 by simply applying (manual) compressive forces to the two plug-type connectors 1, 2 is no longer possible.

In the locking position shown in FIG. 2, the high voltage contact elements 4, 5 of the first 1 and the second plug-type connector 2 are not yet in electrical contact (although they are already in mechanical contact; however, electrically insulating head elements 14 of the plug-formed high voltage contact elements 4 of the first plug-type connector 1 prevent electrically conductive contact). In contrast, an electrically conductive contact already exists between two earth contact elements 15, 16 of the two plug-type connectors. The earth contact elements 15 of the second plug-type connector 2 are thereby designed as ring-formed male connectors which each engage into a socket, equipped with spring-biased tabs, (earth contact element 16) of the first plug-type connector 1.

In order to bring the high voltage contact elements 4, 5 of the two plug-type connectors 1, 2 into electrically conductive contact, it is now necessary to shift the locking bracket 6 on the housing 7 of the first plug-type connector 1 in the direction of the high voltage cables 3. The movement of the locking bracket 6 is thereby transferred, via the form-locking connection between the locking tabs 8 and the locking projections 11, to the second plug-type connector 2, which as a result is drawn into the first plug-type connector.

The shifting of the locking bracket 6 of the housing 7 of the first contact plug 1 is guided by means of two guide projections 17 on the housing 7, which each project into a guide groove 18 in one of the locking tabs 8 and is effected by means of a threaded spindle comprising a threaded bolt 19 and a head 20. A tool can be fitted to the head in order to rotate the threaded spindle. The head 20 of the threaded spindle can be rotated within a through-aperture of a cable-side part of the housing 7, but is mounted fixed in an axial direction by means of a C-ring 21. The threaded bolt 19 passes through a through-aperture in the bridge 9 of the locking bracket 6, wherein an outer thread of the threaded bolt 19 engages with an inner thread of the through-aperture. The end of the threaded bolt 19 opposite the head 20 is unthreaded and is mounted rotatably in an opening in a bearing plate 22 held in the housing 7. In order to shift the locking bracket 6, the threaded spindle is rotated in a clockwise direction by means of a tool, whereby the rotation of the threaded bolt 19 leads, through the threaded engagement with the locking bracket 6, to a translation of the locking bracket 6 relative to the housing 7 of the first plug-type connector 1 (and the contact elements arranged therein).

An electrically conductive contact between the high voltage contact elements 4, 5 of the first 1 and second plug-type connector 2 already exists in a first contact position of the plug-type connection. This first contact position is still located (in relation to the relative movement of the two plug-type connectors 1, 2) before a second contact position shown in FIG. 3 and in particular roughly centrally between the two relative positions of the two plugtype connectors 1, 2 shown in FIGS. 2 and 5.

Figure 5:
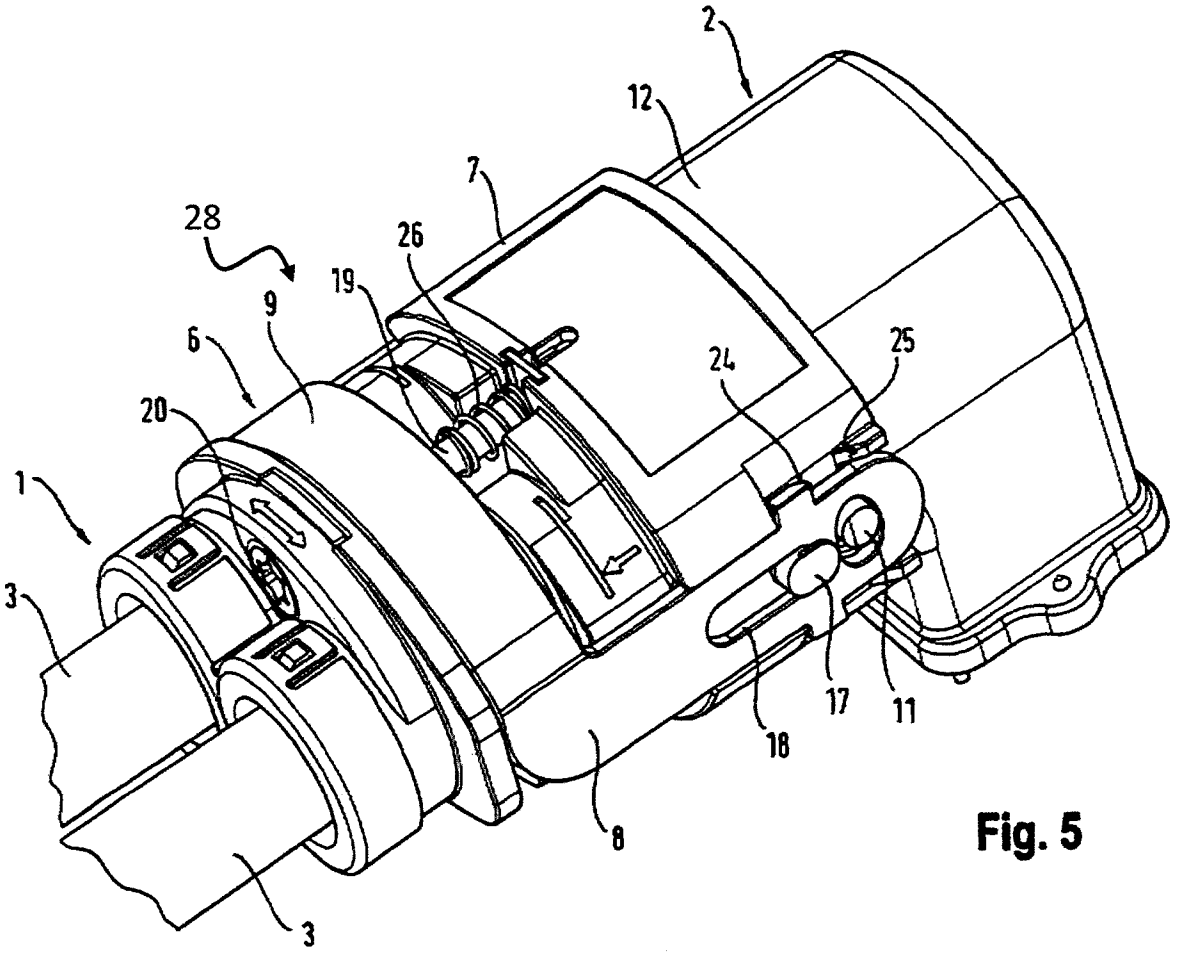
FIG. 5 shows the plug-type connection as shown in FIGS. 1 and 2 in a contact position.

Although a contact between the high voltage contact elements 4, 5 of the two plug-type connectors 1, 2 is already achieved in the first contact position, in order for the plug-type connection to function, this still requires a plugging together of the two plug-type connectors 1, 2 as far as the second contact position shown in FIG. 5. For this purpose the threaded spindle is rotated further in a clockwise direction. In the second contact position, the high voltage contact elements 4, 5 remain in contact, whereby, in addition, (low voltage) contact elements 23 of a low voltage safety circuit are also brought into contact. These low voltage contact elements 23 do not yet touch one another in the first contact position. The purpose of the safety circuit is only to allow a high voltage to be applied to the high voltage cables 3 when the high voltage contact elements 4, 5 contact one another securely. This is always the case when the low voltage contact elements 23 are also in contact. Accordingly, a plugging-together or disconnection of the plug-type connection under high voltage can be prevented. This both increases the safety of assembly personnel handling the plug-type connection as well as preventing the plug-type connection from being damaged due to an electrical sparkover.

In the second contact position, the guide projections 17 ensure, by means of an edge region projecting beyond the guide groove 18, that the locking tabs 8 cannot be deflected laterally. There is thus no possibility of disconnecting the plug-type connection through a manual deflection of the locking tabs 8 and application of a tensile force to the two plug-type connectors 1, 2.

Rather, in order to disconnect the plug-type connection again, the threaded spindle must be rotated in an anticlockwise direction by means of the tool. This moves the locking bracket 6 in the direction of the second plug-type connector 2, as a result of which this is pushed out of the first plug-type connector 1. The low voltage contact elements 23 of the safety circuit are thereby first disconnected and then—as the first contact position is passed—the high voltage contact elements 4, 5. The disconnecting movement between the two plug-type connectors 1, 2 is effected by means of the threaded spindle until the locking position (see FIG. 2) is reached. Then the bridge 9 of the locking bracket 6 is shifted on the threaded bolt so far that the outer thread of the threaded bolt 19 and the inner thread of the bridge 9 no longer engage with one another. In order to completely disconnect the two plug-type connectors a tensile force must then be applied to these, as a result of which the locking bracket 6 on the housing 7 of the first plug-type connector 1 is moved further in the direction of the second plug-type connector 2. Sloping surfaces 24 of the locking tabs 8 thereby slide on sloping surfaces 25 of the housing 7. This leads to a lateral deflection of the locking tabs 8, as a result of which the locking projections 11 of the second plug-type connector 2 are released (see FIG. 6).

Figure 6:
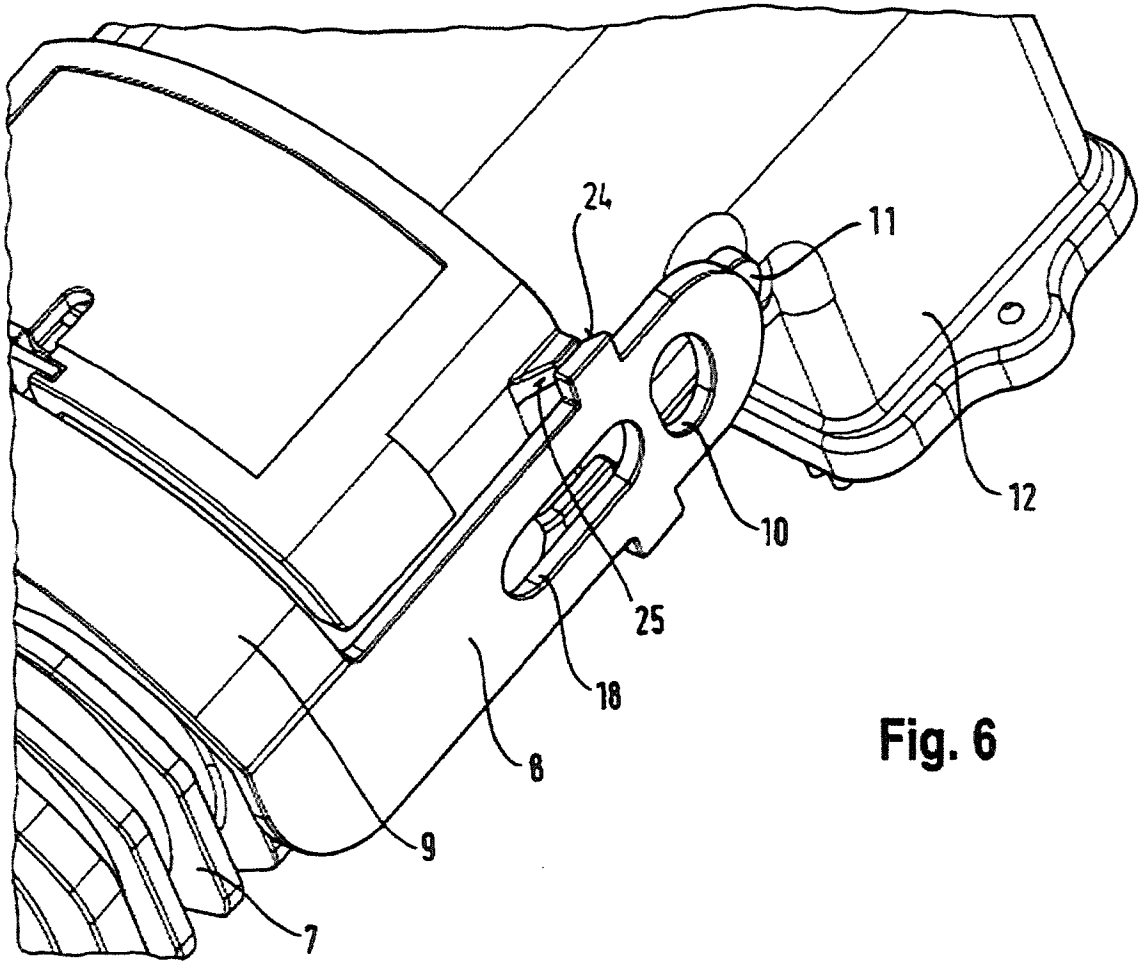
FIG. 6 shows the plug-type connection in accordance with the FIGS. 1 to 3 in a release position.

The displacement of the locking bracket 6 relative to the housing 7 from the locking position shown in FIG. 2 into the release position shown in FIG. 6 leads to a compression of a spring 26 arranged on an unthreaded section of the threaded bolt 19 which is thereby further pre-tensioned. As a result of the pre-tensioning of the spring 26, the locking bracket 6 is automatically moved back into the position shown in FIGS. 1 and 2 after the locking projections 11 are released. This position allows a renewed engagement of the outer thread of the threaded bolt 19 in the inner thread of the bridge 9 of the locking bracket 6. The plug-type connectors are thus ready to be plugged together again.

The first plug-type connector 1 possesses a sealing element 27 which serves to seal off the contact elements of the plug-type connectors 1, 2 from the environment, at least in the contact positions of the plug-type connection. For this purpose the sealing element 27 is deformed into an annular space formed by the plug-type connectors 1, 2 in the contact positions of the plug-type connection. In contrast, in the locking position (see FIG. 2) the sealing element 27 is still out of contact with the housing 12 of the second plug-type connector 2.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug-type connection comprising a first plug-type connector and a second plug-type connector, wherein the first plug-type connector and the second plug-type connector, each possess at least one first electrical contact element, which electrical contact elements can be brought into contact with one another by plugging together the first plug-type connector and the second plug-type connector, such that the first plug-type connector includes a first locking element with which a second locking element of the second plug-type connector can be clipped together in a manner resistant to tensile and compressive forces in a locking position of the plug-type connection by engagement, wherein the first and/or the second locking element can be moved, through a shifting apparatus with one or more threaded spindles rotatable within a through-aperture of the first plug-type connector, in a plugging direction relative to the contact element of the associated plug-type connector, into a first contact position of the plug-type connection in order to make contact between the contact elements of the first plug-type connector and the second plug-type connector.

2. The plug-type connection of claim 1, wherein the first locking element comprises a projection and the second locking element comprises an elastically deflectable locking tab having a locking aperture which snaps around the projection.

3. The plug-type connection of claim 1, wherein the shifting apparatus is configured for releasing the clip connection of the first and the second locking elements.

4. The plug-type connection of claim 3, wherein, starting out from the locking position, the first and/or the second locking element is shiftable into a release position of the plug-type connection in which the clip connection of the first and the second locking elements is released by means of the shifting apparatus.

5. The plug-type connection of claim 4, wherein the second locking element includes a sloping surface designed such that the shift into the release position leads to a deflection of the locking tab.

6. The plug-type connection of claim 4, wherein the first and/or the second locking element is loaded in the direction of the locking position through a spring element arranged on the threaded spindle which is pre-biased in the release position.

7. The plug-type connection of claim 1, wherein the first and the second plug-type connectors, each include at least one second electrical contact element which make contact in the locking position.

8. The plug-type connection of claim 1, wherein the first and the second plug-type connectors, each includes at least one further electrical contact element which make contact in a second contact position, wherein the second contact position is achieved, starting out from the locking position, by shifting the first and/or the second locking element beyond the first contact position in the plugging direction by means of the shifting apparatus.

9. The plug-type connection of claim 8, including a securing device comprising a low voltage safety circuit with contact elements which prevents a release of the clip connection of the first and the second locking elements in the first and/or second contact position, wherein the contact elements are always in contact when high voltage contacts of the first and the second plug-type connectors are in contact.

10. The plug-type connection of claim 8, including a sealing element which, in the first and/or second contact position, is deformed into a gap formed between the first and the second plug-type connectors and which is not deformed in the locking position.

11. The plug-type connection of claim 2, wherein the shifting apparatus is configured for releasing the clip connection of the first and the second locking elements.

12. The plug-type connection of claim 11, wherein, starting out from the locking position, the first and/or the second locking element is shiftable into a release position of the plug-type connection in which the clip connection of the first and the second locking elements is released by means of the shifting apparatus.

13. The plug-type connection of claim 4, wherein the first and the second locking elements include sloping surfaces designed such that the shift into the release position leads to a deflection of the locking tab.

14. The plug-type connection of claim 5, wherein the first and/or the second locking element is loaded in the direction of the locking position through a spring element arranged on the threaded spindle which is pre-biased in the release position.

15. The plug-type connection of claim 2, wherein the first and the second plug-type connectors, each includes at least one second electrical contact element which make contact in the locking position.

16. The plug-type connection of claim 12, wherein the first and the second plug-type connectors, each includes at least one second electrical contact element which make contact in the locking position.

17. The plug-type connection of claim 5, wherein the first and the second plug-type connectors, each includes at least one further electrical contact element which make contact in a second contact position, wherein the second contact position is achieved, starting out from the locking position, by shifting the first and/or the second locking element beyond the first contact position in the plugging direction by means of the shifting apparatus.

18. The plug-type connection of claim 6, wherein the first and the second plug-type connectors, each includes at least one further electrical contact element which make contact in a second contact position, wherein the second contact position is achieved, starting out from the locking position, by shifting the first and/or the second locking element beyond the first contact position in the plugging direction by means of the shifting apparatus.

19. The plug-type connection of claim 17, including a securing device comprising a low voltage safety circuit with contact elements which prevents a release of the clip connection of the first and the second locking elements in the first and/or the second contact position, wherein the contact elements are always in contact when high voltage contacts of the first and the second plug-type connectors are in contact.

20. The plug-type connection of claim 8, including a sealing element which, in the first and/or the second contact position, is deformed into a gap formed between the first and the second plug-type connectors and which is not deformed in the locking position, wherein the second contact position is achieved from the locking position by shifting the first and/or the second locking element beyond the first contact position, and lies behind the first contact position in relation to the plugging direction.

* * * * *